United States Patent [19]

Natterer

[11] Patent Number: 4,567,713

[45] Date of Patent: Feb. 4, 1986

[54] METHOD OF AND APPARATUS FOR PRODUCING A PACKAGE

[75] Inventor: Johann Natterer, Legau, Fed. Rep. of Germany

[73] Assignee: Multivac Sepp Haggenmuller KG, Wolfertschwenden, Fed. Rep. of Germany

[21] Appl. No.: 610,029

[22] Filed: May 14, 1984

[30] Foreign Application Priority Data

May 25, 1983 [DE] Fed. Rep. of Germany ..... 3318993

[51] Int. Cl.[4] ..... B65B 53/06; B65B 47/10

[52] U.S. Cl. ..... 53/433; 53/442; 53/453; 53/511; 53/557; 53/559

[58] Field of Search ..... 53/97, 407, 427, 432, 53/433, 441, 442, 453, 510, 512, 556, 557

[56] References Cited

U.S. PATENT DOCUMENTS 3,321,886 5/1967 Griffith et al. ..... 53/442

3,956,867 5/1976 Utz et al. ..... 53/433

4,137,688 2/1979 Utz et al. ..... 53/432

*Primary Examiner*—Horace M. Culver

*Attorney, Agent, or Firm*—Donald Brown; Robert T. Gammons

[57] ABSTRACT

A method of producing a package is provided wherein a product is brought into a depression formed using a shrinkable sheet material, a cover is brought over the depression, the sheet material is shrunk by heating and the depression is closed with a cover by heat-sealing. In order to shrink the depression free from creases onto different and irregular product surfaces steam is admitted to the sheet material having a saturation temperature above the sheet material temperature such that the steam condensing at the sheet material transfers its heat of condensation to the sheet material. The apparatus for performing the method comprises a sealing station with an upper tool and a lower tool movable relatively thereto and having a chamber for receiving the depression, the chamber being connected with a steam generator.

9 Claims, 3 Drawing Figures

METHOD OF AND APPARATUS FOR PRODUCING A PACKAGE

BACKGROUND OF THE INVENTION

The invention relates to a method of producing a package wherein a depression is formed in a shrinkable sheet material by deep drawing, the article to be packaged is brought into the depression, a cover is brought over the depression, the depression is transferred into a surrounding chamber, the chamber is evacuated, the sheet material is heated to a shrinkage temperature and the depression is closed with the cover by heat-sealing. The invention further relates to a packaging apparatus for performing this method.

A method of this kind is known from the German Patent No. 23 64 565. In this method a shrinkage of the sheet material forming the depression is obtained by bringing the sheet material into complete contact with heated walls and thus heating to the shrinkage temperature. It is therefore necessary to adapt the position of the heated walls to the form of the depression in order to avoid a further stretching of the sheet material in pressing the same to the walls. Hence each wall arrangement is only suitable for a single depression size. Furthermore, the sheet material is not heated any longer after lifting from the heated walls and thus can rapidly cool down when contacting the product to be packaged, which may lead to a premature end of the shrinking procedure.

A packaging method is known from the German patent specification No. 23 60 847 wherein components surrounded by a shrinkable foil are brought into an autoclave and steam is admitted thereto, wherein the foils are covered with clothes. Due to the steam temperature of more than 100° C. the foils are heated to a softening temperature. Furthermore a controlled heating to a predetermined final temperature is not possible in this way.

OBJECTS OF THE INVENTION

It is an object of the invention to provide an improved method of producing a package, in which the above mentioned drawbacks are avoided.

It is a further object to provide a method of producing a package which allows a controlled heating of depressions of different sizes to a shrinkage temperature.

It is a still further object of the invention to provide a method of producing a package wherein an efficient heat transfer to the sheet material is effected also during the shrinkage.

It is a further object of the invention to provide an improved packaging apparatus allowing a controlled heating of depressions of different sizes to a shrinking temperature and an effective heat transfer to the sheet material also during the shrinking.

SUMMARY OF THE INVENTION

In order to achieve the above mentioned objects the invention provides a method of producing a package, wherein a depression is formed in a shrinkable sheet material by deep drawing, the article to be packaged is brought into the depression, the cover is brought over the depression, the depression is transferred into a surrounding chamber, the chamber is evacuated, heated steam is admitted to the evacuated chamber until the pressure within the chamber reaches a pressure value having a corresponding saturation temperature being substantially equal to the shrinkage temperature of the sheet material, and the depression is closed by the cover by heat-sealing.

The invention further provides a packaging apparatus comprising a sealing station having an upper tool part with a heating element and a lower tool part being movable relatively thereto and having a chamber for receiving the depression, wherein the chamber in the lower tool part is connected with a steam generator.

Hence heating is achieved by transmission of the heat of condensation of the steam to the sheet material. Due to the high amount of the heat of condensation the condensation of a small amount of steam at the sheet material is sufficient for an efficient heating to a temperature required for shrinking, and further the temperature of the sheet material is always close to the saturation temperature of the steam. Hence, knowing the actual vapour pressure, also the sheet material temperature is known due to the functional dependency of the saturation temperature and vapour pressure, which allows a heating to an exactly predefined final temperature. In the beginning the heat transfer by condensation takes place in a uniform manner over the depression independent of the shape thereof and continues during the shrinking operation, when the sheet material fits against the product to be packaged. A too rapid cooling of those regions of the sheet material which first fit against the product is avoided in that way that condensation at those regions being slightly colder is increased and thus also heat transmission thereto is increased. In order to support the depression against sinking as a consequence of the heat supply the depression is preferably acted upon from below by a pressure being higher than the pressure acting upon the depression from above.

BRIEF DESCRIPTION OF THE DRAWINGS

Further advantages, features and objects of the invention will stand out from the following description of examplary embodiments with reference to the drawings, wherein.

DESCRIPTION OF PREFERRED EMBODIMENTS

Figure 1:
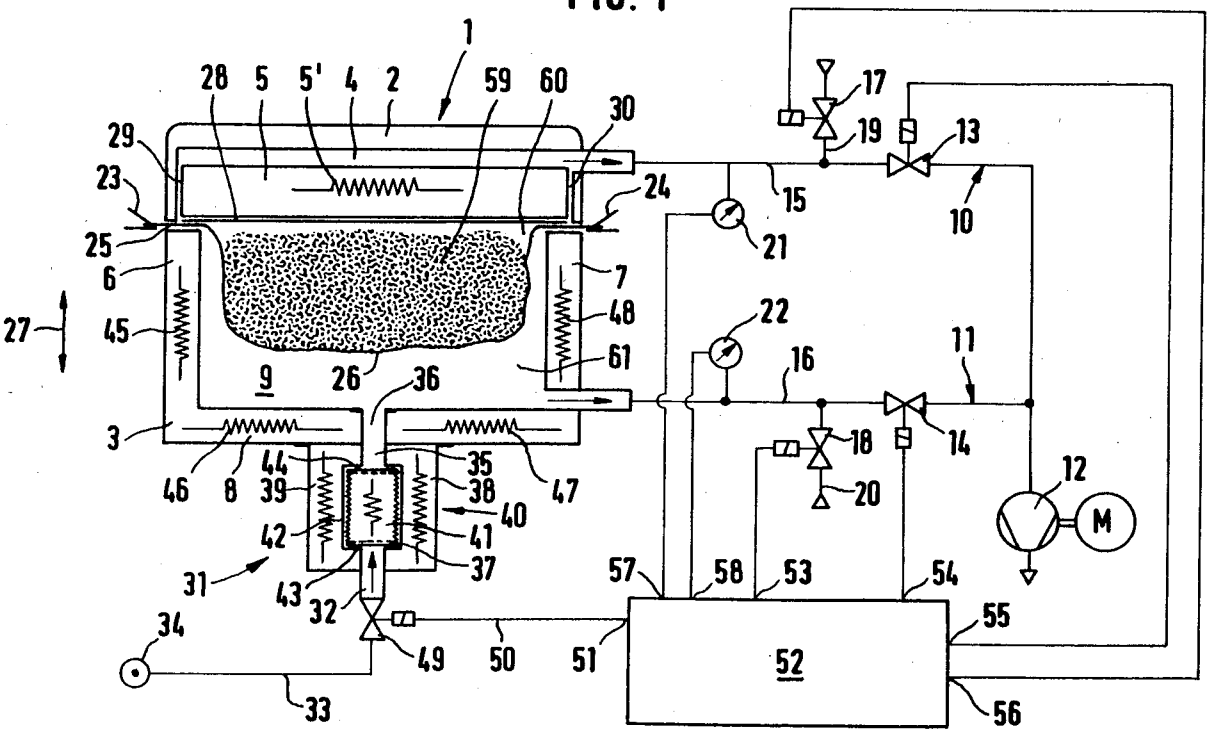
FIG. 1 is a schematic representation of a first embodiment of the inventive apparatus.

FIG. 1 represents a sectional view of a sealing station 1 comprising an upper tool part 2 and a lower tool part 3. The upper tool part 2 has, on its side facing the lower tool part 3, an upper chamber 4 forming a recess, in which a heated sealing plate 5 with a heating element 5' is arranged. The lower tool part 3 is formed as a container open towards the upper tool part 2, the side walls 6, 7 and the bottom 8 thereof enclosing a chamber 9.

The upper chamber 4 is connectable with a vacuum pump 12 by means of a connecting conduit 10 and the chamber 9 is connectable with the vacuum pump 12 by means of a connecting conduit 11. Both connecting conduits 10, 11 each comprise a shut-off valve 13, 14 and respective branch conduits 19, 20 to the ambient atmosphere, which may be closed by respective venting valves 17, 18, in the portions 15, 16 of the connecting conduits 10, 11 between the chambers 4, 9 and the shut-off valves 13, 14. Respective pressure gauges 21, 22 being formed as contact vacuometer having two preselected settings are provided in the regions 15, 16, the preselected settings being adjusted in a manner described further below.

Transport means 23, 24 are arranged between the upper tool part 2 and the lower tool part 3 on both sides, the transport means being adapted to laterally engage a sheet material 25 with a depression 26 formed in the sheet material and moving the same into the sealing station 1. In order to allow the depression to move into the sealing station 1 the lower tool part 3 is movable up and down in the direction of the double arrow 27. A cover 28 is brought over the depression 26, the cover having about the width of the sealing plate 5 and being slightly narrower than the upper chamber 4 such that a distance 29, 30 is formed between the edges of the cover 28 and the sealing plate 5 and the side walls of the upper tool part 2.

A steam generator 31 is provided below the lower tool part 3. The inlet 32 of the steam generator 31 is connected with a water main 34 via a conduit 33 and the outlet 35 of the steam generator 31 is connected with the chamber 9 via an opening 36 in the bottom 8. The steam generator 31 comprises a cylindrical interior space 37 between the inlet 32 and the outlet 35, the interior space being surrounded by the heated walls 38, 39 of a housing 40. A cylindrical body 41 is provided within the interior space 37. The outer diameter of the cylindrical body 41 corresponds to the inner diameter of the interior space 37 and the length of the cylindrical body corresponds closely to the length of the interior space 37. The body 41 has a helical flute 42 in the form of an external thread on its surface extending over its total length. The flute 42 is connected with the inlet 32 and the outlet 35, respectively, via channels 43, 44 in the end planes. Thus the flute 42 forms the only connection from the inlet 32 to the outlet 35 in the form of a narrow capillary system or channel having a large heated surface sufficient to completely evaporate water supplied to the inlet 32. The body 41 is heated by the contact with the heated walls 38, 39. However, also a separate heating of the body 41 can be provided. The steam generator 31 is directly attached to the lower tool part 3. The side walls 6, 7 and the bottom 8 of the lower tool part 3 are also heatable by means of heating elements 45, 46, 47, 48.

A valve 49 being connected with the output 51 of control means 52 via a line 50 is provided in the conduit 33. The control means 52 further comprises outputs 53, 54, 55, 56 which are connected with the respective valves 18, 14, 13, 17, as well as inputs 57, 58 being connected with the vacuometers 21 and 22, respectively. The design and the function of the control means is described in connection with the following operating steps with reference to FIG. 3.

For producing a package the depression 26 is filled with product 59, the lower tool part 3 is lowered and the depression 26 with the product 59 is moved below the upper tool part 2 into the position shown in FIG. 1 by means of the transport means 23, 24. Thereupon the lower tool part 3 is moved upward and the depression 26 enters the chamber 9. The cover 28 in the form of a cover foil is supplied to the sealing station 1 simultaneously with the depression 26 and in connection with the depression 26 defines a space 60 containing the product 59. The space 60 is connected with the upper chamber 4 via the distances 29, 30, whereas that region 61 of the chamber 9 which surrounds the depression 26 on the outside thereof is tightly separated from the chamber 4 and the space 60 by means of the sheet material 25 and the depression 26, respectively.

After the closure of the sealing station 1 the control means 52 shuts the valves 17, 18 and opens the valves 13, 14. The upper chamber 4 and the space 60 connected thereto is evacuated via the conduit 10 and the region 61 of the lower chamber 9 is evacuated via the conduit 11 by means of the vacuum pump 12. The respective pressure decrease from point A in FIG. 3 (dotted line) is indicated by the vacuometers 21, 22. When a desired vacuum, preferably between 10 to 20 mbar, is reached in region 61 (point B in FIG. 3) the vacuometer 22 provides a signal to the control means 52 which thereupon shuts the valve 14. Hence only the upper chamber 4 and the space 60 are further evacuated until a pressure of preferably 2 to 10 mbar is reached.

Figure 3:
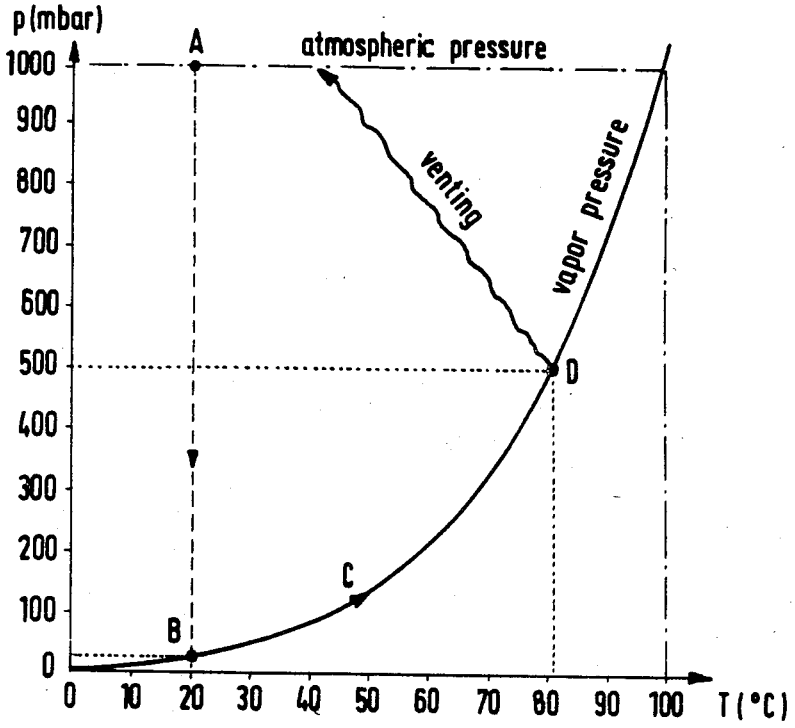
FIG. 3 is a diagrammatic representation of the heating process according to the inventive method.

The control means 52 opens the valve 49 simultaneously with or immediately after closing the valve 14, thereby causing water to flow from the water main 34 into the steam generator 31. The water enters the bottom region of the steam generator 31 and is heated and evaporated by contacting the surfaces of the steam generator which are heated to e.g. 150° to 200° C., rises along the flute 42 as a consequence of the expansion due to the evaporation and enters the region 61 through the opening 36 in the form of steam. Preferably the evaporation is performed already in the bottom region of the steam generator or in the lower part of the flute 42 such that the steam is superheated during the further rise through the flute 42. If the pressure in the region 61 is chosen such that corresponding to the vapour pressure diagram the saturation temperature of the steam at this pressure is higher than the temperature of the depression 26, then part of the steam condenses at the outside of the depression 26 and heats the same up by supplying thereto the heat of condensation. Since, however, the pressure in the region 31 rises due to the supply of steam, also the saturation temperature rises according to the dependency given by the vapour pessure diagram of water, which leads to further condensation at the sheet material and thus to further heating thereof. This increase of the pressure and the temperature is shown in FIG. 3 by arrow C. The supply of steam and thus the heating of the depression 26 by means of condensation is continued until a pressure value is reached in the region 61 corresponding to the saturation temperature being such that the sheet material 25 is heated by means of condensation to such a temperature that the sheet material 25 shrinks in the region of depression 26 due to the release of the latent shrinking forces. Preferably this pressure is in the region from about 500 to 700 mbar, corresponding to a saturation temperature of about 80° to 90° C. (point D in FIG. 3). Since due to the transfer of the heat of condensation the temperature of the depression 26 is always close to the saturation temperature the depression is therefore heated up to about 80° C. The sheet material 25 is drawn onto the product 59 in the region of the depression 26 due to the shrinking forces released by means of this heating. Because the pressure in the region 61 is higher than the pressure in the upper chamber 4 and the space 60 due to the entering steam the sheet material 25 is pressed onto the product 59 in the region of the depression 26 and the same is pressed upwardly to the cover 28 such that further sheet material of the depression 26 not directly contacting the product may shrink and the space 60 is reduced to a minimum.

As soon as the pressure gauge 22 detects that the pressure in region 61 has risen to an upper pressure value of about 500 mbar (point D) adjusted with respect to the sheet material the control means 52 shuts the valve 49. Thereupon the sealing plate 5 is lowered and thus the cover foil 28 is sealed with the sheet material 25. Subsequently the control means 52 shuts the valve 13 and opens the valves 17, 18 such that the complete sealing station 1 is vented. By lowering the lower tool part 3 the closed package can be moved out of the station and a new filled depression 26 may be entered into the station.

By means of the heating elements 45, 46, 47, 48 the side walls 6, 7 and the bottom 8 of the lower tool part 3 are kept at a temperature which is always higher than the saturation temperature of the steam in region 61 at all pressures encountered, preferably at 100° to 120° C. It is thus avoided that steam condenses at the interior surface of the lower tool part 3 and leads to an accumulation of water. This heating further allows an economical steam consumption since otherwise a large amount of the steam supplied would immediately condensate at the walls 6, 7 and at the bottom 8 and thus the pressure in region 31 would just slowly rise.

Figure 2:
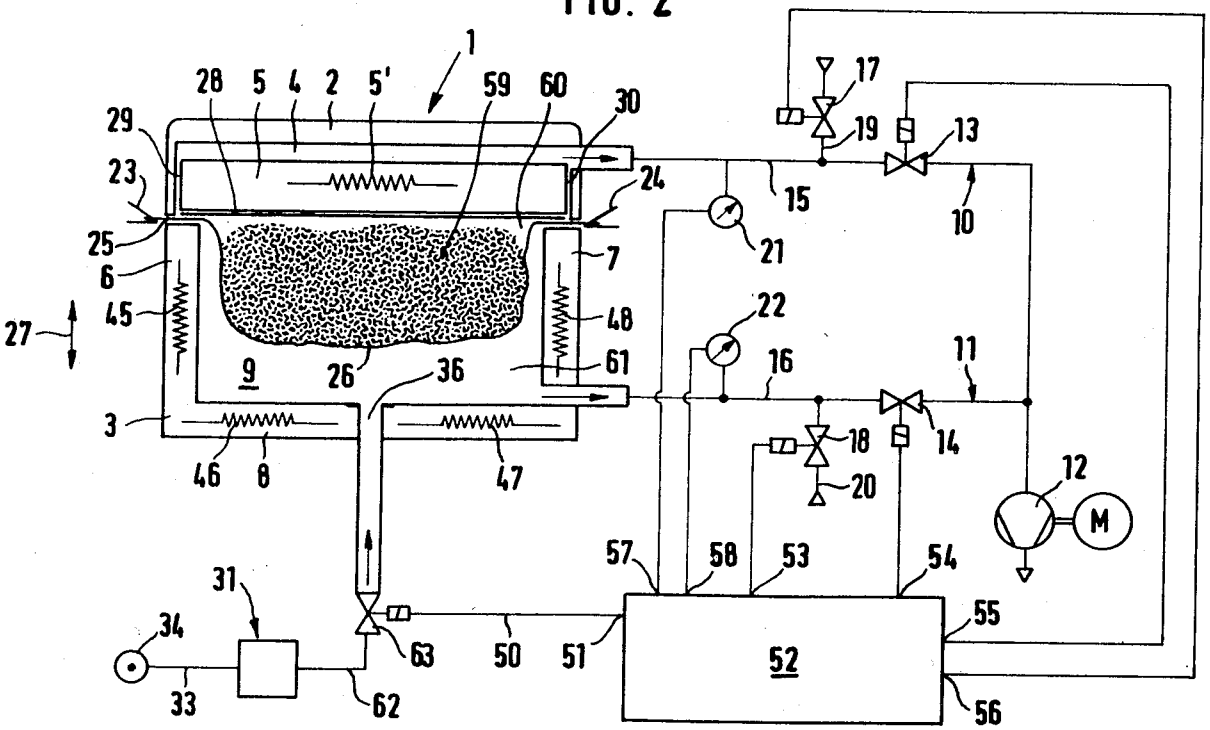
FIG. 2 is a schematic representation of a second embodiment of the inventive apparatus.

In the embodiment described above the steam is generated by means of a steam generator directly attached to the lower tool part 3. According to the embodiment shown in FIG. 2 a separate steam generator or steam source 31 is provided which may for example also be represented by the steam supply of a factory or plant. The steam source 31 is connected with the chamber 9 via a steam conduit 62 comprising a steam valve 63 which may be operated by the control means 52 such that the desired pressure in region 61 is adjusted in the above described manner.

Although condensation and thus heat transfer takes place preferably at those zones of the depression 26 which fit against the product 59 and thus have a lower temperature, the heat transmission to the sheet material by condensation leads to a preferred shrinking of those zones of the sheet material which do not fit against the product, for example creases, due to the lacking heat conduction thereat. By this means the heating of the depression 26 by condensation supports the shrinking of the creases and the smooth fitting of the sheet material even to products with irregular surface.

The temperature region suitable for releasing the shrinking forces differs for different sheet materials used. An adaptation to those different temperatures is possible by a preselection of the final pressure value when the supply of steam in region 61 is terminated. The only thing required for this adaptation is the corresponding adjustment of the second preselected setting of the pressure gauge 22.

What is claimed is:

1. The method of packaging, comprising forming a depression in a heat-shrinkable sheet material by deep drawing such as to define a receptacle with a rim peripherally thereof, depositing the article to be packaged into the receptacle, providing a cover sheet of an area coextensive with the rim of the receptacle, placing the assembly comprising the receptacle and cover sheet in a closed chamber, evacuating the closed chamber, delivering heated steam into the evacuated chamber, measuring the pressure within the closed chamber, terminating delivery of steam into the closed chamber when the pressure in the closed chamber reaches a value corresponding to the saturation temperature of the steam which is substantially equal to the shrinkage temperature of the sheet material and heat-sealing the cover sheet to the rim of the receptacle.

2. The method of claim 1 wherein the steam is superheated.

3. The method of claim 1 wherein the walls of the chamber are heated to a temperature above the saturation temperature of the steam.

4. The method of claim 1, wherein the space surrounding the article to be packaged within the receptacle is evacuated during the heating of the sheet to an evacuation pressure being below the pressure in the chamber surrounding the outside of the depression.

5. Apparatus for producing a package by forming a depression in a heat-shrinkable sheet material such as to define a receptacle with a peripheral rim, inserting the article to be packaged into the receptacle and covering and heat-sealing a cover sheet to the rim of the receptacle; the apparatus comprising a sealing station having an upper tool part embodying a heating element and a lower tool part movable relative thereto, said lower tool comprising a chamber for receiving said receptacle, a steam generator connected with said chamber via a steam duct, means for measuring the pressure within said chamber and means for controlling the supply of steam to said chamber, said controlling means being controlled by said measuring means to start the supply of steam to said chamber at a first predetermined pressure within said chamber and to stop the supply of steam to said chamber at a second predetermined pressure within said chamber, said second predetermined pressure corresponding to a saturation temperature of said steam which is substantially equal to the shrinkage temperature of said sheet material.

6. The apparatus of claim 5, wherein said upper tool part comprises an upper chamber and said upper chamber and said chamber are adapted to be selectively connected with the suction side of a vacuum pump or with the ambient air by means of a connecting conduit.

7. The apparatus of claim 5, wherein said steam generator comprises a heated housing with a cylindrical interior space, a cylindrical body being inserted into said cylindrical space, said cylindrical body having an outer diameter corresponding to the inner diameter of said interior space and comprising a flute disposed on the cylindrical surface thereof and extending from one end plane to the other end plane of said body.

8. The apparatus of claim 7, wherein a heating element is provided in the walls surrounding said chamber.

9. The apparatus of claim 5, wherein a steam conduit comprising a steam valve is provided between said steam generator and said lower tool part.

* * * * *